US006508849B1

(12) United States Patent
Comas

(10) Patent No.: US 6,508,849 B1
(45) Date of Patent: Jan. 21, 2003

(54) FIRE STARTER AS SOLE FUEL TO QUICKLY IGNITE A LOG OF WOOD

(75) Inventor: Christian Comas, St-Eustache (CA)

(73) Assignee: La Corde de Bois Inc., St-Eustache (CA)

( * ) Notice: Subject to any disclaimer, the term of this patent is extended or adjusted under 35 U.S.C. 154(b) by 0 days.

(21) Appl. No.: 09/579,367

(22) Filed: May 26, 2000

(51) Int. Cl.[7] ..... C10L 5/00; C10L 11/04
(52) U.S. Cl. ..... 44/543; 44/544; 44/534
(58) Field of Search ..... 44/532, 533, 534, 44/541, 543, 544

(56) References Cited

U.S. PATENT DOCUMENTS

| | | | | | |
|---|---|---|---|---|---|
| 167,849 | A | * | 9/1875 | Maynard | 44/534 |
| 1,447,237 | A | * | 3/1923 | Coyne | 44/532 |
| 2,240,335 | A | | 4/1941 | Keil | |
| 2,548,379 | A | * | 4/1951 | Lammersen | 44/519 |
| 3,034,873 | A | | 5/1962 | Weir | |
| 3,988,121 | A | | 10/1976 | Leveskis | |
| 4,060,396 | A | | 11/1977 | Burton | |
| 4,063,904 | A | | 12/1977 | Beeson | |
| 4,095,957 | A | | 6/1978 | Orsing | |
| 4,179,270 | A | * | 12/1979 | Clayton | 44/541 |
| 4,877,417 | A | | 10/1989 | Crace | 44/535 |
| 4,878,922 | A | | 11/1989 | Kaye | 44/502 |
| 4,906,254 | A | | 3/1990 | Antosko | 44/520 |
| 5,273,555 | A | | 12/1993 | Decarlo | 44/540 |
| 5,456,732 | A | * | 10/1995 | Baxter | 44/519 |
| 5,626,636 | A | * | 5/1997 | Carter | 44/533 |
| 5,743,248 | A | | 4/1998 | Jansen, Jr. | 126/25 B |

FOREIGN PATENT DOCUMENTS

| | | |
|---|---|---|
| CA | 1129287 | 8/1982 |
| CA | 2232593 | 2/1999 |

* cited by examiner

*Primary Examiner*—Cephia D. Toomer
(74) *Attorney, Agent, or Firm*—Collard & Roe, P.C.

(57) ABSTRACT

The present invention relates to a fire starter for use as sole fuel to ignite a log of wood in order to start a campfire or a fire in a fireplace easily and quickly. Advantageously, starting a fire with the fire starter of the present invention avoids the necessity of using paper and/or firewood. The fire starter is made of a sealed flammable bag enclosing wood shavings treated with at least one combustible solution. Inside the bag, the wood shavings are in contact with each other and sufficiently spaced from each other to allow air circulation therebetween. A flame-retardant sheet is optionally inserted in the bag, underneath the treated wood shavings.

14 Claims, 4 Drawing Sheets

FIRE STARTER AS SOLE FUEL TO QUICKLY IGNITE A LOG OF WOOD

FIELD OF THE INVENTION

The present invention relates to a fire starter for use as sole fuel to ignite a log of wood in order to start a campfire or a fire in a fireplace. Starting a fire with the fire starter of the present invention avoids the necessity of using paper and/or firewood.

BACKGROUND

Traditionally, one starts a fire in a fireplace (or a campfire) by using paper, branches and firewood, and then stacking logs of wood on top. The paper is ignited, and usually the logs "catch" on fire after a few minutes. One disadvantages with this approach is that fires don't always start, for a variety of reasons. Furthermore, paper and/or firewood isn't always available. Consequently, alternative solutions have been proposed, and will be referred to as fuel elements.

One type of fuel element is known as a <<mini-log>> and the following patents are representative of this type of fuel element: U.S. Pat. Nos. 4,060,396, 3,988,121 and CA 1,129, 287. Generally, they include cellulosic material, such as sawdust, which is mixed with wax and compacted into a small log. These <<mini-logs>> can be used to replace charcoal briquettes (for food grilling purposes in a BBQ) or to ignite logs or briquettes for various purposes. When used for igniting logs such as in a fireplace, the <<mini-log>> usually needs to be complemented with paper and/or firewood to efficiently start a fire.

Various fuel elements are disclosed in the following patents: U.S. Pat. Nos. 2,240,335, 3,034,873, 4,063,904, 4,095,957, 4,906,254. These patents suggest the use of different combustible materials such as charcoal and wood lumps, with or without wax, solvent or the like, added thereto, and assembled in very particular and complex packaging in order to make the fuel element. These fuel elements are used for food grilling or for starting a fire.

In a related field, U.S. Pat. No. 4,877,417 discloses an artificial log made of clay and carbonaceous material and intended to be used in a fireplace with a gas burner.

Also known in the art are portable campfires, such as the ones disclosed in U.S. Pat. No. 5,743,248 and CA patent application no. 2,232,593; and portable assemblies for picnic cooking, as disclosed in U.S. Pat. No. 5,273,555.

There is a need for an efficient fuel element that can be used alone, i.e. without the use of paper or firewood, for igniting a log of wood and therefore starting a fire in a fireplace or a campfire with a minimum amount of time.

SUMMARY OF THE INVENTION

The present invention is directed to a fire starter that satisfies the above mentioned need.

In accordance with the present invention, this object is achieved with a fire starter for use as sole fuel to ignite a log of wood. The fire starter comprises wood shavings treated with at least one combustible solution; and a sealed flammable bag having a top and a bottom and enclosing the wood shavings, so that the wood shavings are in contact with each other and sufficiently spaced from each other to allow air circulation therebetween.

The invention and its advantages will be better understood upon reading the non restrictive description of a preferred embodiment of the present invention. This description is given with reference to the appended drawings.

DETAILED DESCRIPTION OF PREFERRED EMBODIMENTS OF THE INVENTION

Figure 1:
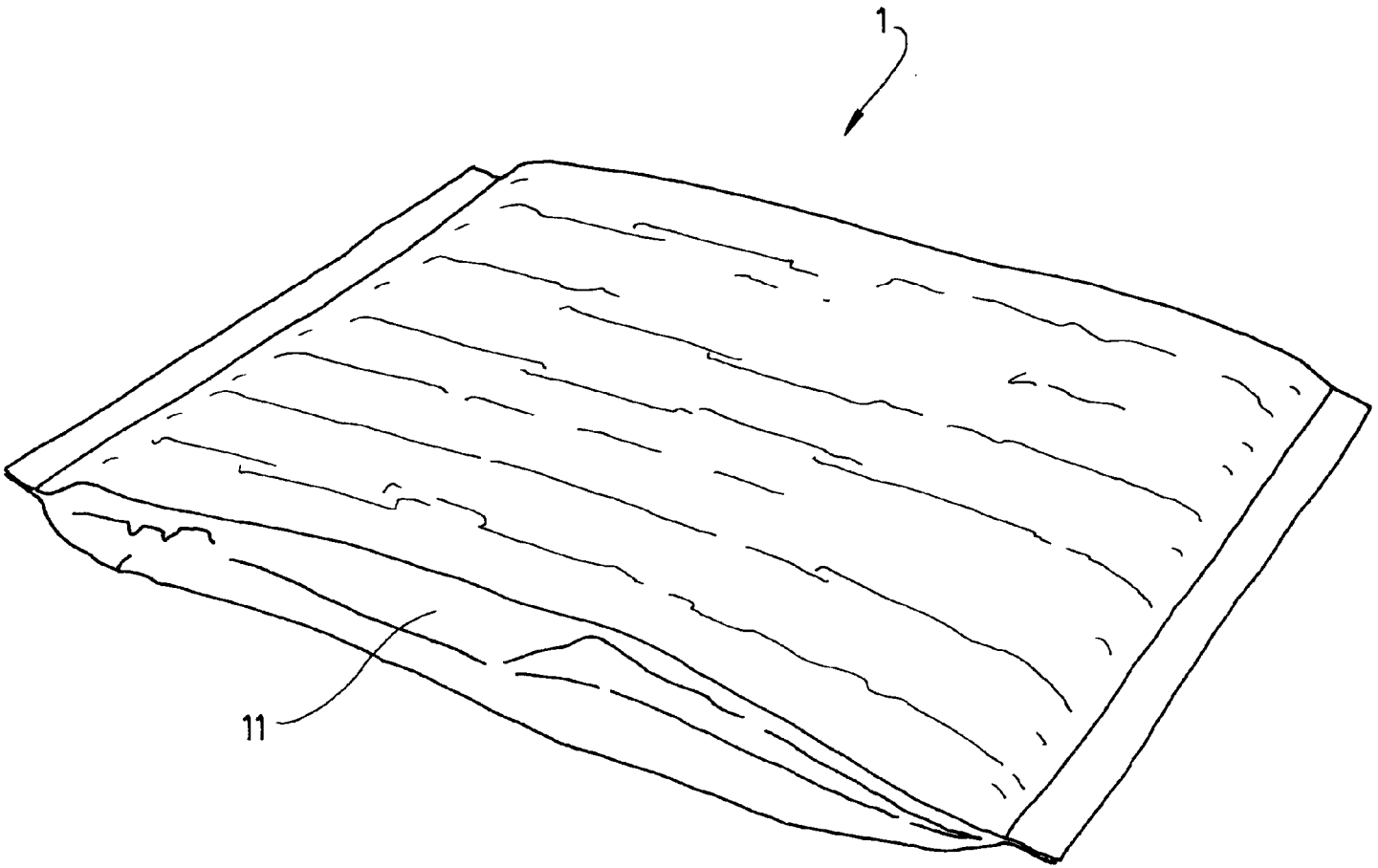
FIG. 1 is a perspective view of the fire starter according to the present invention.

Referring to FIG. 1, the present invention relates to a fire starter (1) for use as sole fuel to ignite a log of wood (not shown). An important aspect of the invention is that no other fuel, such as paper, kindling, firewood, etc, is required with the fire starter of the invention to start a fire. The word "firewood" includes dry sticks of wood typically used to start a fire.

A typical log of wood is one to two feet long and has a width varying from between about three to about ten inches. The fire starter (1) of the present invention can set fire to one or several logs of wood simultaneously. It is to be understood that the fire starter (1) can ignite at least one log. The size of the log of wood and the number of logs to be ignited do not matter, since the fire starter (1) is able to produce a flame of sufficient intensity to ignite at least one log of wood without using paper or lightwood in order to start a campfire or a fire in a fireplace. However, to quickly prepare a fire in a fireplace or a campfire, it is suggested to ignite three logs of wood all at once.

Figure 2:
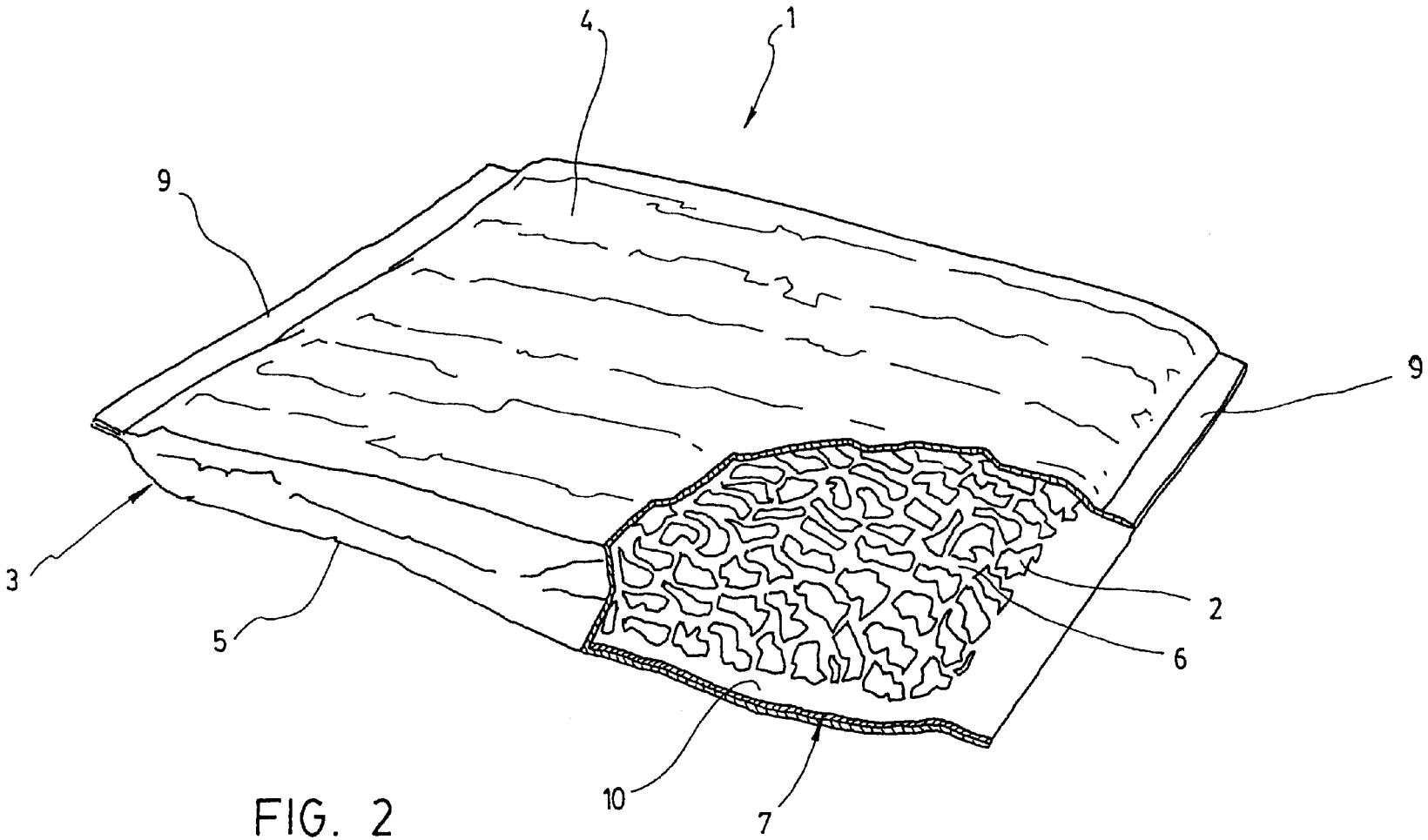
FIG. 2 is a perspective view similar to FIG. 1 except that a portion of the bag is cut out.
Figure 3:
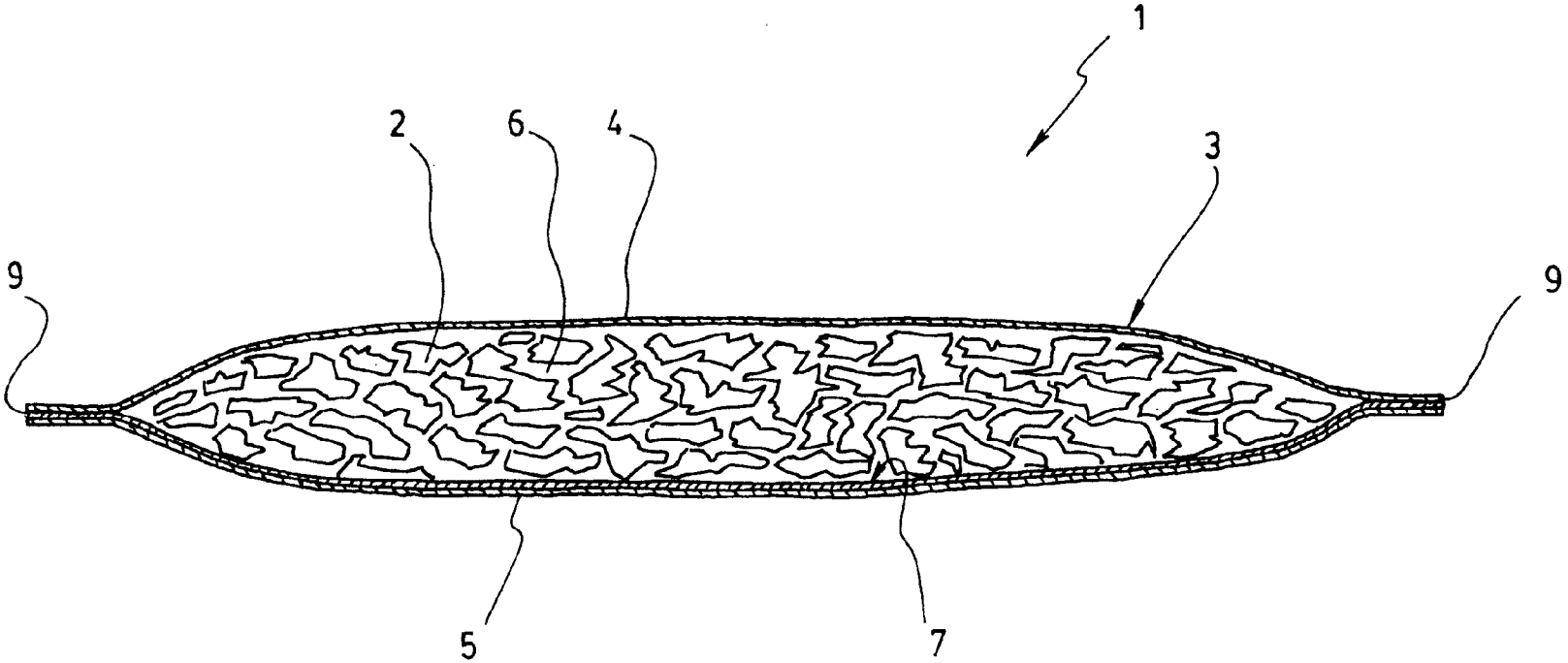
FIG. 3 is a longitudinal cross-sectional view of a first embodiment of the fire starter of the present invention.
Figure 4:
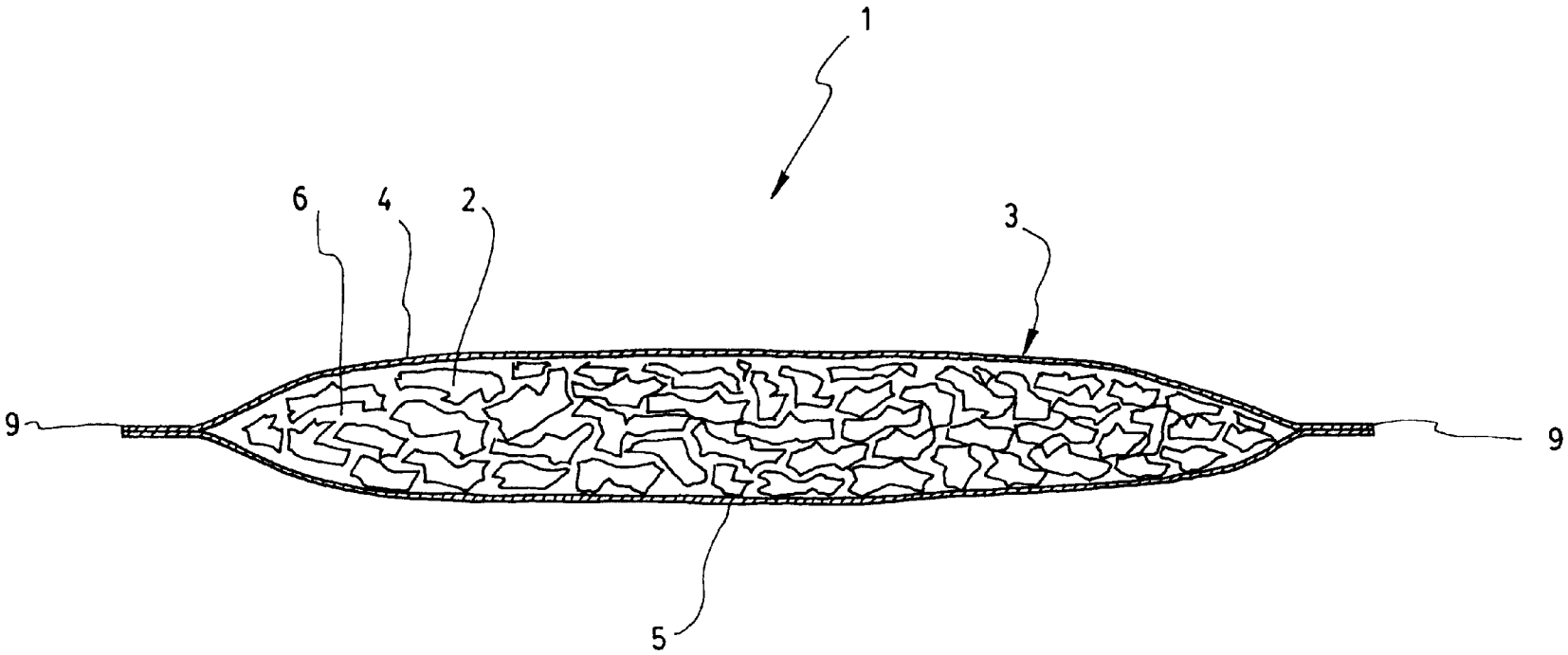
FIG. 4 is a longitudinal cross-sectional view of a second embodiment of the fire starter of the present invention.

Referring to FIGS. 2, 3 and 4, the fire starter (1) comprises wood shavings (2) treated with at least one combustible solution and a sealed flammable bag (3) having a top (4) and a bottom (5). The bag (3) encloses the wood shavings (2) so that the wood shavings (2) are in contact with each other but sufficiently spaced from each other to allow air circulation (6) therebetween. Preferably, the bag (3) is filled with treated wood shavings (2) but the wood shavings (2) are not tightly packed together. The <<mini-log>> of the prior art is made of compacted materials and produces a low and long lasting flame. Contrary to the prior art, the present invention is designed to produce an intense flame in a short time so that a fire is started very quickly. The intensity of the flame is such that it obviates the use of paper and/or lightwood to start the fire. Thus, for starting the fire with one or a few logs of wood (preferably three logs as above mentioned), the user only needs the fire starter (1) of the present invention and something to set fire to it such as matches. After the fire is started with the fire starter (1) of the present invention, the user will just have to continuously feed it to maintain it alive in a known manner.

According to the first preferred embodiment of the invention, the fire starter (1) further comprises a flame-retardant sheet (7) inside the bag (3), underneath the treated wood shavings (2) as shown in FIGS. 2 and 3. The flame-retardant sheet (7) is useful when the fire starter (1) is put on a grate of a fireplace or the like. In use, the bag (3) burns rapidly and the wood shavings (2) need to be kept together for generating an intense flame. The flame-retardant sheet (7) does not burn as fast as the bag (3) and will retain the wood shavings (2) on the grate or the like. Preferably, the flame-retardant sheet (7) is adapted to resist disintegration, under combustion conditions, for at least 45 minutes. The sheet, after that time, disintegrates in the form of dust and/or small particles and can be thrown away with the ashes of the fireplace.

Advantageously, the flame-retardant sheet (7) completely covers the bottom (5) of the bag (3) as partially shown in FIG. 2. It should be understood that the configuration of the bag (3) and the sheet (7) can be different from the one illustrated in the appended drawings, and can be modified to comply with manufacturing restrictions.

Preferably, the flame-retardant sheet (7) is an aluminium sheet (7). The aluminium sheet (7) has a reflecting side (10) which is advantageously oriented towards the wood shavings (2) as shown in FIG. 2. Thus, the heat of the burning wood shavings (2) is reflected by the reflecting side (10) of the sheet (7) and serves to increase the intensity of the flame generated by the burning wood shavings (2).

Since the manufacturing process involves a step of sealing the two opposite ends (9) of the bag (3) with heat, the aluminium sheet (7) is preferably laminated using known techniques, with polyethylene on both sides thereof. Such lamination allows the aluminium sheet (7) to stick to the bag (3) (which is preferably made of paper as mentioned below) under heat and pressure conditions provided at the two opposite ends (9) of the bag (3) for sealing it. The aluminium sheet preferably (7) has a thickness varying between 0,235 $\mu$m and 0,350 $\mu$m; and such an aluminium sheet (7) being laminated as described above, provides enough strength to the sheet (7) to be manipulated in the manufacturing process without tearing. The thickness of the aluminium sheet (7) has an effect on the flame-retardant character of the sheet (7): the thicker the sheet (7), the longer it will take to disintegrate. The thickness of the sheet (7) may differ from the above-described preferred range, and can be determined according to the desired disintegration time, the required strength of the sheet (7), and its cost.

According to the second embodiment of the invention, the fire starter (1) does not comprise a flame-retardant sheet (7). The sheet (7) is not an essential element of the invention since it is principally used to hold the wood shavings (2) on the grate or the like when the bag (3) is consumed. When the fire starter (1) according to the second embodiment of the invention, is used for starting a campfire, the fire starter (1) is put directly on the ground at the campfire location and the wood shavings (2) will remain together on the ground after the bag (3) is disintegrated.

The bag (3) is preferably made of paper. The paper can be glossy and can bear the trade-mark inscription and the instructions for the user. In these instructions, it is important to indicate where the top and bottom are, if the fire starter (1) has a flame-retardant sheet (7) according to the first embodiment of the present invention.

Preferably, the bag (3) is substantially flat so that one or more logs of wood can be stacked on the fire starter (1) and easily remain thereon. According to the preferred embodiments of the invention, the bag (3) is rectangular and has a length of 30 cm, a width of 20 cm and a thickness of 4 cm at a centrally located position thereof. The bag (3) preferably has such dimensions that it can be filled with between 2,0 liters and 2,5 liters of treated wood shavings (2).

The at least one combustible solution for treating the wood shavings (2) preferably comprises a first solution and a second solution, where the first solution is an oil and the second solution is a melted wax-like material. The preferred oil is a vegetable oil. However, oils that have a negative environmental impact are preferably avoided. The preferred wax-like material is paraffin. Other wax-like material can be used without departing from the scope of the invention.

The use of between 2,0 liters and 2,5 liters of wood shavings (2) treated with vegetable oil and paraffin within the fire starter (1) of the present invention provides an intense flame in about 30 seconds after being ignited, so that one or more logs of wood catch fire within 3 to 4 minutes. Different combinations of combustible solutions and quantity of treated wood shavings (2) can be employed, but it is preferred to optimize the combination in order to provide an intense flame in such a way that the logs may catch fire within 5 minutes.

The method for preparing the treated wood shavings (2) comprises the steps of (i) sprinkling a predetermined amount of oil on a batch of wood shavings (2) and obtaining oily wood shavings (2); and (ii) sprinkling a predetermined amount of melted wax-like material on the oily wood shavings (2).

Sawmills provide an important quantity of cheap wood particles. Usually, two types of wood shavings (2) are provided by sawmills: the sieved and non-sieved wood shavings (2). Both types can be used, separately or together, to comply with the present invention.

The method for starting a fire in a fireplace using the fire starter (1) according to the first embodiment of the invention, comprises the steps of:

placing the fire starter (1) on the grate of the fireplace with its bottom (5) facing downwardly;

laying at least one log of wood on top (4) of the fire starter (1); and igniting a location on a side (11) of the bag (3) of the fire starter (1).

The method for starting a campfire using the fire starter (1) according to the first or second embodiment of the invention comprises the steps of:

placing the fire starter (1) on the ground fireplace with its bottom (5) facing downwardly;

laying at least one log of wood on top (4) of the fire starter (1); and igniting a location on a side (11) of the bag (3) of the fire starter (1).

Preferably, for starting a campfire, three logs of wood are disposed around and over the fire starter (1) in an upright position and leaning on each other like a teepee.

Referring to FIG. 1, the bag (3) is preferably ignited at a location which is centrally located along the side (11) of the bag (3).

Although a preferred embodiment of the invention has been described in detail and illustrated in the accompanying drawings, it is to be understood that the invention is not limited to these precise embodiments and that various changes and modifications may be made therein without departing from the scope or spirit of the invention as defined in the appended claims.

What is claimed is:

1. A fire starter for use as sole fuel to ignite a log of wood, the fire starter comprising:

wood shavings treated with at least one combustible solution;

a sealed flammable bag having a top and a bottom, said bag enclosing said wood shavings, so that the wood shavings are in contact with each other and sufficiently spaced from each other to allow air circulation therebetween; and a flame-retardant sheet inside the bag, underneath the treated wood shavings.

2. A fire starter according to claim 1, wherein the flame-retardant sheet completely covers the bottom of the bag.

3. A fire starter according to claim 1, wherein the flame-retardant sheet is thick enough to resist disintegration, under combustion conditions, for at least 45 minutes.

4. A fire starter according to claim 1, wherein the flame-retardant sheet is an aluminium sheet.

5. A fire starter according to claim 4, wherein the aluminium sheet has a thickness varying between 0.235 $\mu$m and 0.350 $\mu$m.

6. A fire starter according to claim 4, wherein the aluminium sheet has a reflecting side which is oriented towards the wood shavings.

7. A fire starter according to claim 1, wherein at least one combustible solution comprises a first solution and a second solution, where the first solution is an oil and the second solution is melted paraffin.

8. A fire starter according to claim 7, wherein the oil is a vegetable oil.

9. A fire starter according to claim 7, wherein the treated wood shavings are prepared by:

sprinkling oil on a batch of wood shavings and obtaining oily wood shavings; and sprinkling melted paraffin on the oily wood shavings.

10. A fire starter according to claim 1, wherein the bag is made of paper.

11. A fire starter according to claim 1, wherein the bag is substantially flat.

12. A fire starter according to claim 11, wherein the bag has a length of 30 cm and a width of 20 cm.

13. A fire starter according to claim 1, wherein the bag is filled with between 2.0 liters and 2.5 liters of treated wood shavings.

14. A fire starter according to claim 8, wherein the bag is filled with between 2.0 liters and 2.5 liters of treated wood shavings.

* * * * *